US007255088B2

(12) United States Patent
Nakamura et al.

(10) Patent No.: US 7,255,088 B2
(45) Date of Patent: Aug. 14, 2007

(54) ENGINE CONTROL SYSTEM FOR CONSTRUCTION MACHINE

(75) Inventors: Kazunori Nakamura, Tsuchiura (JP); Yasushi Arai, Tsuchiura (JP); Yoichi Kowatari, Ibaraki-ken (JP); Kouji Ishikawa, Ibaraki-ken (JP); Hideo Karasawa, Tsuchiura (JP)

(73) Assignee: Hitachi Construction Machinery Co. Ltd., Tokyo (JP)

( * ) Notice: Subject to any disclaimer, the term of this patent is extended or adjusted under 35 U.S.C. 154(b) by 325 days.

(21) Appl. No.: 10/527,418

(22) PCT Filed: Jun. 24, 2004

(86) PCT No.: PCT/JP2004/009279

§ 371 (c)(1),
(2), (4) Date: Mar. 14, 2005

(87) PCT Pub. No.: WO2004/113704

PCT Pub. Date: Dec. 29, 2004

(65) Prior Publication Data

US 2006/0118082 A1 Jun. 8, 2006

(30) Foreign Application Priority Data

Jun. 25, 2003 (JP) ..... 2003-181582

(51) Int. Cl.
*F02D 41/04* (2006.01)
*F02D 41/14* (2006.01)

(52) U.S. Cl. ..... 123/352; 123/339.16

(58) Field of Classification Search ..... 123/339.16, 123/352–355, 357

See application file for complete search history.

(56) References Cited

U.S. PATENT DOCUMENTS 3,982,508 A * 9/1976 Norlin et al. ..... 123/378
4,779,591 A * 10/1988 Tordenmalm ..... 123/352
5,893,816 A 4/1999 Ashida ..... 477/111

FOREIGN PATENT DOCUMENTS

JP 4-1183 1/1992
JP 2000-154803 6/2000
JP 2001-173605 6/2001
JP 3414159 4/2003

* cited by examiner

*Primary Examiner*—T. M. Argenbright
(74) *Attorney, Agent, or Firm*—Mattingly, Stanger, Malur & Brundidge PC

(57) ABSTRACT

An engine control system includes pressure sensors (73, 74), position sensors (75, 76), pressure sensors (77, 78), a target revolution speed modification value computing unit (90), and a modification value adder (70*r*). A target revolution speed NR2 for use in control is computed based on changes of status variables such that the target revolution speed NR2 increases from the target revolution speed NR1 applied from an input unit (71), and then moderately returns to the target revolution speed NR1. In accordance with the computed target revolution speed NR2 for use in control, a target fuel injection amount FN1 is computed and a fuel injection amount is controlled. As a result, a drop of an engine revolution speed attributable to an abrupt increase of an engine load can be suppressed without sacrificing the work efficiency, and lowering of durability caused by an excessive increase of the engine revolution speed can be prevented.

5 Claims, 10 Drawing Sheets

INVENTION

ENGINE CONTROL SYSTEM FOR CONSTRUCTION MACHINE

TECHNICAL FIELD

The present invention relates to an engine control system for a construction machine, and more particularly to an engine control system for a construction machine in which a variable displacement hydraulic pump is driven by a diesel engine to drive a hydraulic actuator.

BACKGROUND ART

In general, a construction machine such as a hydraulic excavator comprises an engine, at least one variable displacement hydraulic pump driven by the engine, a plurality of hydraulic actuators driven by a hydraulic fluid delivered from the hydraulic pump, a plurality of flow control valves for controlling respective flow rates of the hydraulic fluid supplied from the hydraulic pump to the plurality of hydraulic actuators, and a plurality of control lever devices serving as operating means to operate the plurality of flow control valves. Also, a diesel engine is employed as the engine for driving the hydraulic pump. The diesel engine is equipped with a fuel injector, called a governor, to control an amount of fuel injected, thereby controlling a revolution speed of the engine.

In such a diesel engine equipped with a fuel injector, when a control lever of the control lever device is quickly manipulated for shift of the flow control valve, an input torque (load) of the hydraulic pump is abruptly increased and the engine revolution speed abruptly drops. This abrupt drop of the engine revolution speed leads to problems of not only deteriorating fuel consumption and exhaust gas, but also causing noises.

Techniques for suppressing such a drop of the engine revolution speed are disclosed in, for example, JP,A 2000-154803 and JP,A 2001-173605.

With the technique disclosed in JP,A 2000-154803, the load state of a hydraulic pump is detected, and when it is detected that a load is applied to the hydraulic pump, a limit value for the input torque of the hydraulic pump is reduced to perform torque decrease control. As a result, the absorption torque of the hydraulic pump (i.e., the engine load) is reduced so as to suppress the drop of the engine revolution speed.

With the technique disclosed in JP,A 2001-173605, the operating speed of a control lever is detected, and when the operating speed exceeds a predetermined value, fuel is supplied in an increased amount to an engine in response to a command signal from a controller. As a result, the engine output is increased so as to suppress the drop of the engine revolution speed.

DISCLOSURE OF THE INVENTION

However, the above-described known techniques have problems as follows.

With the technique disclosed in JP,A 2000-154803, because the drop of the engine revolution speed is suppressed by reducing the absorption torque of the hydraulic pump, the delivery rate of the hydraulic pump is also reduced and so is the actuator speed correspondingly. Hence, an amount of feasible work is reduced and the work efficiency is sacrificed.

The technique disclosed in JP,A 2001-173605 is intended to suppress the drop of the engine revolution speed by supplying the fuel in an increased amount to the engine so that the engine output is increased. However, the engine revolution speed cannot be controlled with an increase of the fuel amount, and there is a possibility that the engine revolution speed goes up beyond a required level. In some cases, the engine revolution speed may exceed a critical level in terms of durability.

It is an object of the present invention to provide an engine control system for a construction machine, which can suppress a drop of an engine revolution speed attributable to an abrupt increase of an engine load without sacrificing the work efficiency, and can prevent lowering of durability caused by an excessive increase of the engine revolution speed.

(1) To achieve the above object, the present invention provides an engine control system for a construction machine comprising an engine, at least one variable displacement hydraulic pump driven by the engine, a plurality of hydraulic actuators driven by a hydraulic fluid delivered from the hydraulic pump, a plurality of flow control valves for controlling respective flow rates of the hydraulic fluid supplied from the hydraulic pump to the plurality of hydraulic actuators, operating means for operating the plurality of flow control valves, a fuel injector for controlling a revolution speed of the engine, input means for commanding a target revolution speed of the engine, and fuel injection amount control means for computing a target fuel injection amount based on the target revolution speed and controlling the fuel injector, wherein the engine control system comprises status variable detecting means for detecting a status variable related to a load of the hydraulic pump, and target revolution speed modifying means for computing a target revolution speed for use in control based on a change of the status variable such that the target revolution speed for use in control increases from the target revolution speed set in accordance with a command from the input unit, and then moderately returns to the target revolution speed set in accordance with the command from the input unit, the fuel injection amount control means computing the target fuel injection amount based on the target revolution speed for use in control.

Thus, the status variable detecting means and the target revolution speed modifying means are provided, and the target revolution speed for use in control is increased depending on the change of the status variable, whereby an actual revolution speed is also increased correspondingly. It is therefore possible to suppress a drop of the engine revolution speed when an engine load is abruptly increased. Also, since the control process is performed on the basis of engine revolution speed, the absorption torque of the hydraulic pump is not reduced and the work efficiency is not sacrificed. Further, the target revolution speed for use in control is computed based on the change of the status variable so as to increase from the target revolution speed set in accordance with the command from the input means and then moderately return to the target revolution speed set in accordance with the command from the input means, and the engine revolution speed is controlled in accordance with the target revolution speed thus computed. As a result, the engine revolution speed can be avoided from going up beyond a required level, and lowering of durability caused by an excessive increase of the engine revolution speed can be prevented.

(2) In above (1), preferably, the target revolution speed modifying means maintains the increased engine revolution speed for a certain time after the change of the status variable has ceased.

With that feature, a drop of the engine revolution speed attributable to an abrupt increase of the engine load can be suppressed with higher certainty.

(3) In above (1), preferably, the target revolution speed modifying means computes an increase amount of the target revolution speed as a variable value depending on the target revolution speed set in accordance with the command from the input unit.

With that feature, as the target revolution speed set in accordance with the command from the input means changes, the increase amount of the target revolution speed is also changed correspondingly. Therefore, an optimum increase amount of the target revolution speed can be computed regardless of the target revolution speed.

(4) In above (1), preferably, the target revolution speed modifying means includes means for computing, based on the change of the status variable, an engine revolution speed modification value which increases from 0 by a predetermined amount and then moderately returns to 0, and means for adding the engine revolution speed modification value to the target revolution speed set in accordance with the command from the input unit.

With that feature, depending on the change of the status variable, the target revolution speed for use in control increases from the target revolution speed set in accordance with the command from the input means and then moderately returns to the target revolution speed set in accordance with the command from the input means.

(5) In above (1), preferably, the status variable detecting means detects, as the status variable related to the load of the hydraulic pump, at least one of operation signals from the operating means, a delivery capacity of the hydraulic pump, and a delivery pressure of the hydraulic pump.

With that feature, the load state of the hydraulic pump can be detected with high accuracy.

BEST MODE FOR CARRYING OUT THE INVENTION

An embodiment of the present invention will be described below with reference to the drawings. In the following embodiment, the present invention is applied to an engine control system for a hydraulic excavator.

A first embodiment of the present invention will be first described with reference to FIGS. 1 to 8.

Figure 1:
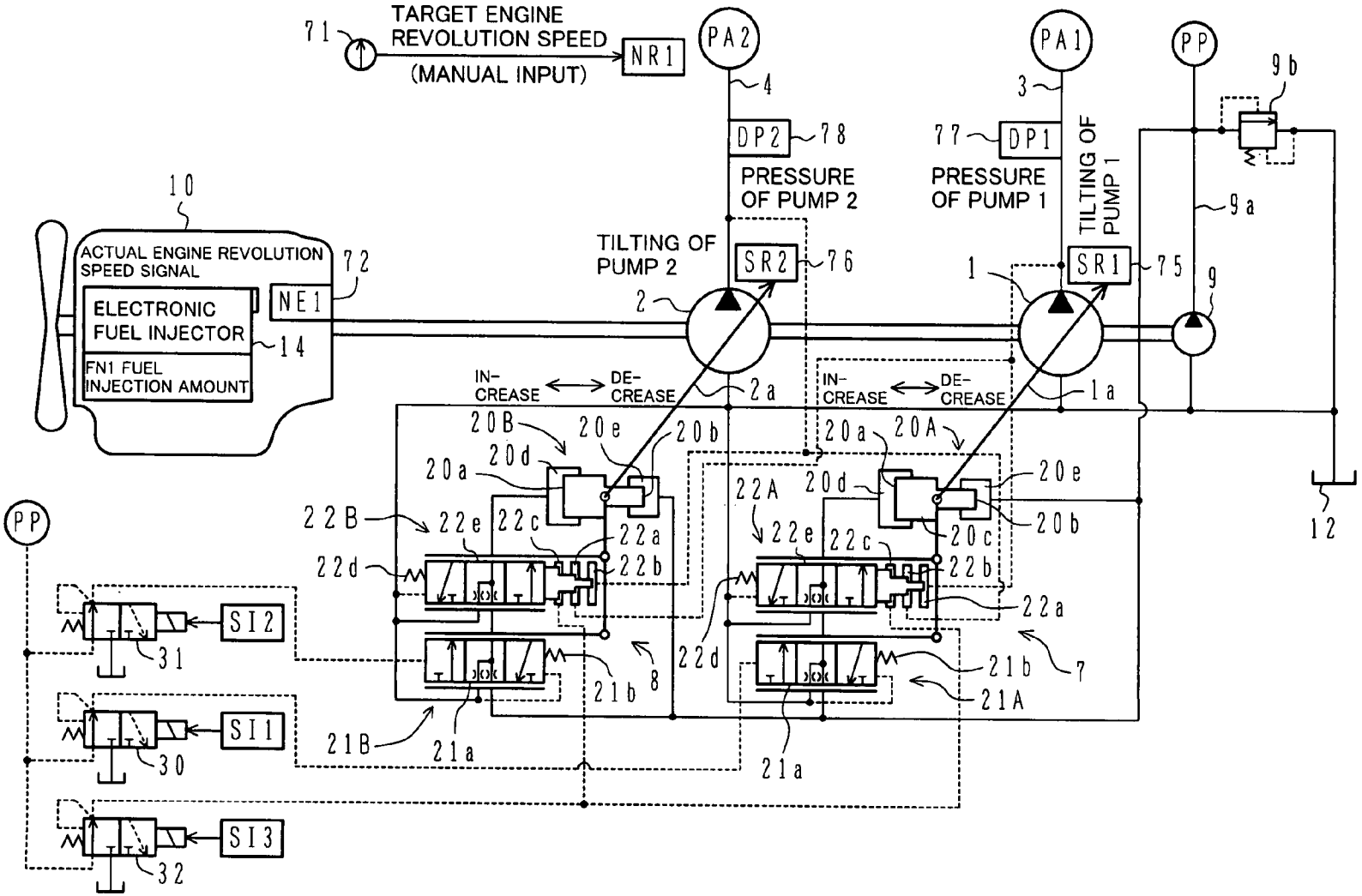
FIG. 1 is a diagram showing an engine/pump control system including an engine control system for a construction machine according to a first embodiment of the present invention.

In FIG. 1, reference numerals 1 and 2 denote variable displacement hydraulic pumps of, e.g., swash plate type. Numeral 9 denotes a fixed displacement pilot pump. The hydraulic pumps 1, 2 and the pilot pump 9 are connected to an output shaft 11 of a prime mover 10 and are driven by the prime mover 10 for rotation.

Figure 2:
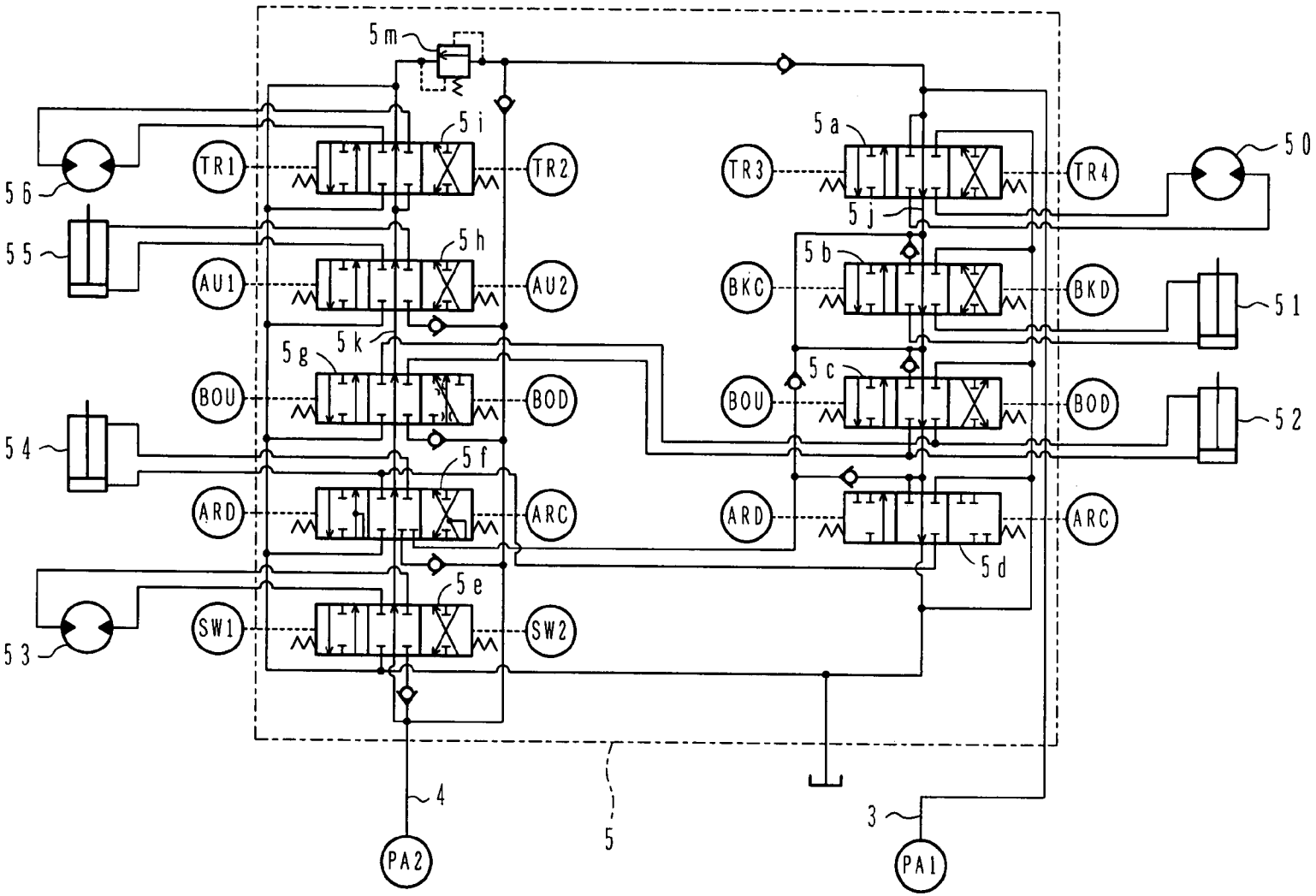
FIG. 2 is a hydraulic circuit diagram of a valve unit and actuators.

A valve unit 5, shown in FIG. 2, is connected to delivery lines 3, 4 of the hydraulic pumps 1, 2. A hydraulic fluid is supplied to a plurality of actuators 50-56 through the valve unit 5, thereby driving the actuators. A pilot relief valve **9*b* for holding the delivery pressure of the pilot pump 9 at a certain pressure is connected to a delivery line 9*a* of the pilot pump 9**.

Details of the valve unit 5 will be described below.

In FIG. 2, the valve unit 5 has two valve groups comprising respectively flow control valves **5*a*-5*d* and flow control valves 5*e*-5*i*. The flow control valves 5*a*-5*d* are positioned on a center bypass line 5*j* connected to the delivery line 3 of the hydraulic pump 1, and the flow control valves 5*e*-5*i* are positioned on a center bypass line 5*k* connected to the delivery line 4 of the hydraulic pump 2. A main relief valve 5*m* for deciding a maximum value of the delivery pressure of the hydraulic pumps 1, 2 is disposed in the delivery lines 3, 4**.

The flow control valves **5*a*-5*d* and the flow control valves 5*e*-5*i* are each of the center bypass type. The hydraulic fluid delivered from the hydraulic pumps 1, 2 is supplied to corresponding one or more of the actuators 50-56 through the associated flow control valves. The actuator 50 is a hydraulic motor for travel on the right side (i.e., a right travel motor), and the actuator 51 is a hydraulic cylinder for a bucket (i.e., a bucket cylinder). The actuator 52 is a hydraulic cylinder for a boom (i.e., a boom cylinder), and the actuator 53 is a hydraulic motor for swing (i.e., a swing motor). The actuator 54 is a hydraulic cylinder for an arm (i.e., an arm cylinder), the actuator 55 is a reserve hydraulic cylinder, and the actuator 56 is a hydraulic motor for travel on the left side (i.e., a left travel motor). The flow control valve 5*a* serves for the travel on the right side, and the flow control valve 5*b* serves for the bucket. The flow control valve 5*c* serves for a first boom, and the flow control valve 5*d* serves for a second arm. The flow control valve 5*e* serves for the swing, the flow control valve 5*f* serves for a first arm, and the flow control valve 5*g* serves for a second boom. The flow control valve 5*h* serves for reserve, and the flow control valve 5*i* serves for the travel on the left side. Stated another way, two flow control valves 5*g*, 5*c* are disposed in association with the boom cylinder 52 and two flow control valves 5*d*, 5*f* are disposed in association with the arm cylinder 54, whereby respective hydraulic fluids from the two hydraulic pumps 1, 2 can be supplied in a joined way to the bottom side of each of the boom cylinder 52 and the arm cylinder 54**.

Figure 3:
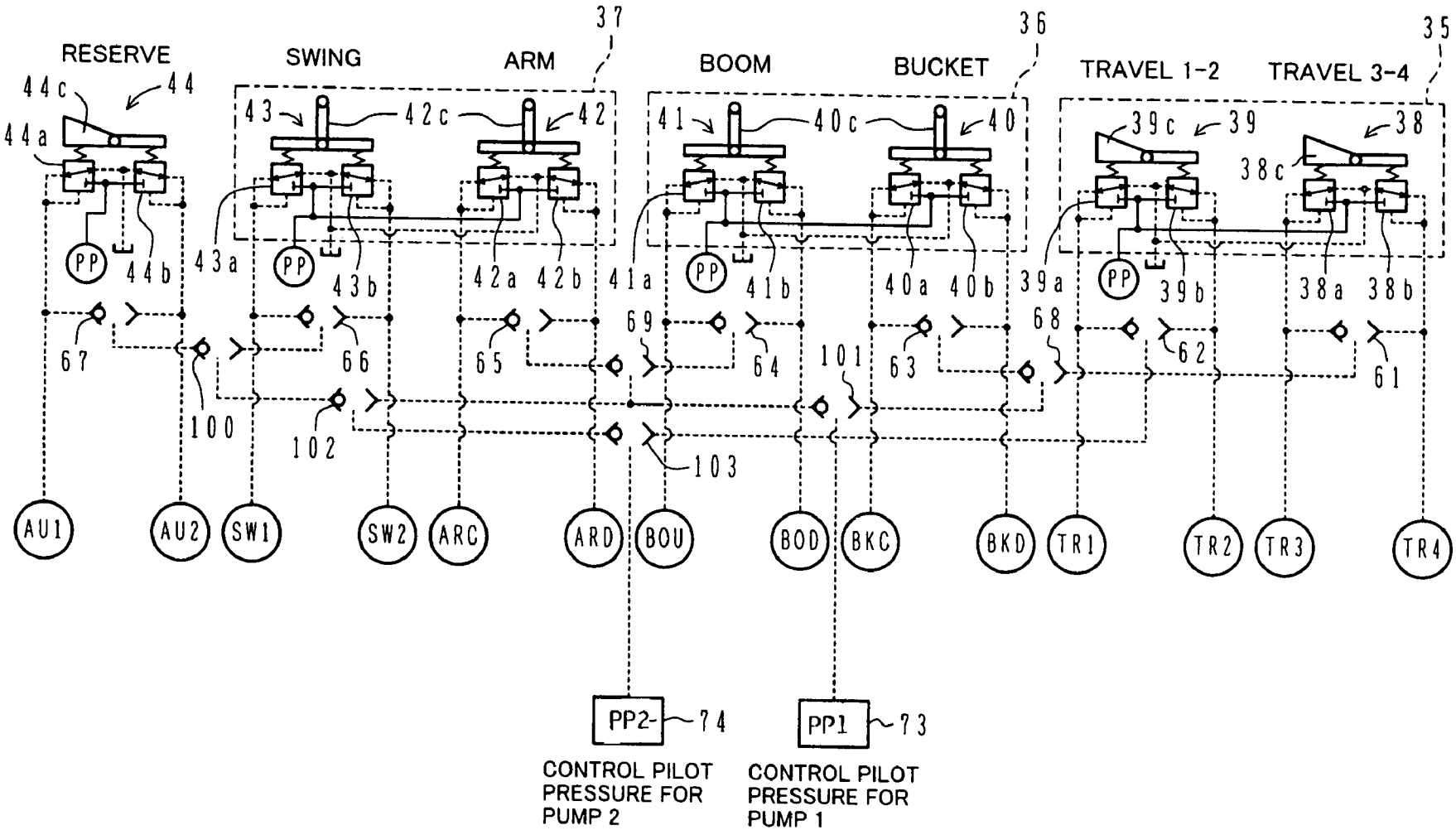
FIG. 3 is a diagram showing an operation pilot system for flow control valves.

FIG. 3 shows an operation pilot system for the flow control valves 5*a*-5*i*.

The flow control valves 5*i*, 5*a* are operated for position shift by operation pilot pressures TR1, TR2; TR3, TR4 produced from operation pilot devices 39, 38 of an operating unit 35. The flow control valve 5*b* and the flow control valves 5*c*, 5*g* are operated for position shift by operation pilot pressures BKC, BKD; BOD, BOU produced from operation pilot devices 40, 41 of an operating unit 36. The flow control valves 5*d*, 5*f* and the flow control valve 5*e* are operated for position shift by operation pilot pressures ARC, ARD; SW1, SW2 produced from operation pilot devices 42, 43 of an operating unit 37. The flow control valve 5*h* is operated for position shift by operation pilot pressures AU1, AU2 produced from an operation pilot device 44.

The operation pilot devices 38-44 have pairs of pilot valves (pressure reducing valves) 38*a*, 38*b*-44*a*, 44*b*, respectively. Further, the operation pilot devices 38, 39 and 44 have control pedals 38*c*, 39*c* and 44*c*, respectively. The operation pilot devices 40, 41 have a common control lever 40*c*, and the operation pilot devices 42, 43 have a common control lever 42*c*. When any of the control pedals 38*c*, 39*c* and 44*c* and the control levers 40*c*, 42*c* is manipulated, the pilot valve of the associated operation pilot device corresponding to the direction of the manipulation is operated and an operation pilot pressure is produced depending on an input amount by which the control pedal or lever is manipulated.

Shuttle valves 61-67, shuttle valves 68, 69 and 100, shuttle valves 101, 102, and a shuttle valve 103 are connected in a hierarchical arrangement to output lines of the respective pilot valves of the operation pilot devices 38-44. The shuttle valves 61, 63, 64, 65, 68, 69 and 101 cooperate to detect a maximum one of the operation pilot pressures from the operation pilot devices 38, 40, 41 and 42 as a control pilot pressure PP1 for the hydraulic pump 1, whereas the shuttle valves 62, 64, 65, 66, 67, 69, 100, 102 and 103 cooperate to detect a maximum one of the operation pilot pressures from the operation pilot devices 39, 41, 42, 43 and 44 as a control pilot pressure PP2 for the hydraulic pump 2.

An engine/pump control system including the engine control system of the present invention is applied to a hydraulic drive system thus constructed. Details of the engine/pump control unit will be described below.

In FIG. 1, the hydraulic pumps 1, 2 are provided with regulators 7, 8, respectively. The regulators 7, 8 regulate tilting positions of swash plates 1*a*, 2*a* that serve as displacement varying mechanisms of the hydraulic pumps 1, 2, thereby controlling respective pump delivery rates.

The regulators 7, 8 for the hydraulic pumps 1, 2 comprise respectively tilting actuators 20A, 20B (hereinafter represented by 20 as appropriate), first servo valves 21A, 21B (hereinafter represented by 21 as appropriate) for performing positive tilting control in accordance with the operation pilot pressures from the operation pilot devices 38-44 shown in FIG. 3, and second servo valves 22A, 22B (hereinafter represented by 22 as appropriate) for performing total horsepower control of the hydraulic pumps 1, 2. Those servo valves 21, 22 control the pressure of a hydraulic fluid supplied from the pilot pump 9 and acting upon the respective tilting actuators 20, thereby controlling the tilting positions of the hydraulic pumps 1, 2.

Details of the tilting actuators 20 and the first and second servo valves 21, 22 will be described below.

Each tilting actuator 20 comprises an working piston 20*c* having a large-diameter pressure bearing portion 20*a* and a small-diameter pressure bearing portion 20*b* which are formed at opposite ends thereof, and a large-diameter pressure bearing chamber 20*d* and a small-diameter pressure bearing chamber 20*e* in which the pressure bearing portions 20*a*, 20*b* are positioned respectively. When the pressures in both the pressure bearing chambers 20*d*, 20*e* are equal to each other, the working piston 20*c* is moved to the right, as viewed in FIG. 1, due to a difference in pressure bearing area, whereupon the tilting of the swash plate 1*a* or 2*a* is reduced to decrease the pump delivery rate. When the pressure in the large-diameter pressure bearing chamber 20*d* lowers, the working piston 20*c* is moved to the left, as viewed in FIG. 1, whereupon the tilting of the swash plate 1*a* or 2*a* is enlarged to increase the pump delivery rate. Further, the large-diameter pressure bearing chamber 20*d* is selectively connected through the first and second servo valves 21, 22 to one of the delivery line 9*a* of the pilot pump 9 and a return fluid line 13 leading to a reservoir 12. The small-diameter pressure bearing chamber 20*e* is directly connected to the delivery line 9*a* of the pilot pump 9.

Each first servo valve 21 for the positive tilting control is a valve operated by a control pressure from a solenoid control valve 30 or 31 to control the tilting position of the hydraulic pump 1 or 2. When the control pressure is low, a valve member 21*a* of the servo valve 21 is moved to the left, as viewed in FIG. 1, by the force of a spring 21*b*, whereupon the large-diameter pressure bearing chamber 20*d* of the tilting actuator 20 is communicated with the reservoir 12 via the return fluid line 13 to increase the tilting of the hydraulic pump 1 or 2. When the control pressure rises, the valve member 21*a* of the servo valve 21 is moved to the right, as viewed in FIG. 1, whereupon the pilot pressure from the pilot pump 9 is introduced to the large-diameter pressure bearing chamber 20*d* to decrease the tilting of the hydraulic pump 1 or 2.

Each second servo valve 22 for the total horsepower control is a valve operated by both the delivery pressure of the hydraulic pump 1 or 2 and a control pressure from a solenoid control valve 32 to perform the total horsepower control of the hydraulic pump 1 or 2. In other words, the second servo valve 22 controls a maximum absorption torque of the hydraulic pump 1 or 2 in accordance with the control pressure from the solenoid control valve 32.

More specifically, the delivery pressures of the hydraulic pumps 1, 2 and the control pressure from the solenoid control valve 32 are introduced respectively to pressure bearing chambers 22*a*, 22*b* and 22*c* of the second servo valve 22. When the sum of hydraulic forces of the delivery pressures of the hydraulic pumps 1, 2 is smaller than a setting value that is determined depending on a difference between the force of a spring 22*d* and the hydraulic force of the control pressure introduced to the pressure bearing chamber 22*c*, a valve member 22*e* is moved to the right, as viewed in FIG. 1, whereupon the large-diameter pressure bearing chamber 20*d* of the tilting actuator 20 is communicated with the reservoir 12 via the return fluid line 13 to increase the tilting of the hydraulic pump 1 or 2. As the sum of hydraulic forces of the delivery pressures of the hydraulic pumps 1, 2 increases in excess of the above-mentioned setting value, the valve member 22*e* is moved to the left, as viewed in FIG. 1, whereupon the pilot pressure from the pilot pump 9 is transmitted to the pressure bearing chamber 20*d* to decrease the tilting of the hydraulic pump 1 or 2.

Further, when the control pressure from the solenoid control valve 32 is low, the above-mentioned setting value is increased so that the tilting of the hydraulic pump 1 or 2 starts to decrease from a relatively high delivery pressure of the hydraulic pump 1 or 2. As the control pressure from the solenoid control valve 32 rises, the above-mentioned setting value is reduced so that the tilting of the hydraulic pump 1 or 2 starts to decrease from a lower delivery pressure of the hydraulic pump 1 or 2.

Figure 4:
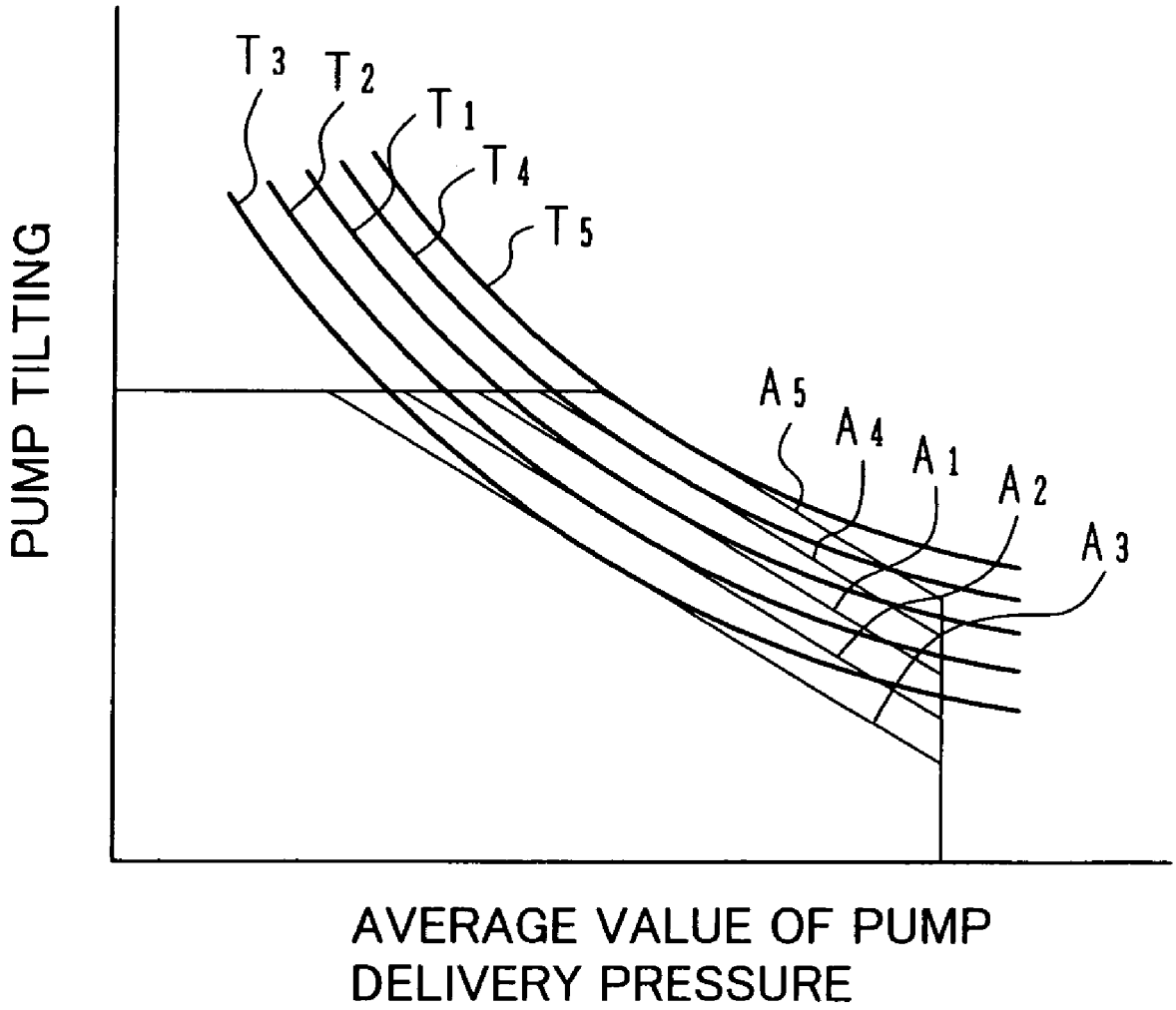
FIG. 4 is a graph showing control characteristics of pump absorption torque provided by a second servo valve of a pump regulator.

FIG. 4 shows characteristics of absorption torque control performed by the second servo valve 22. In FIG. 4, the horizontal axis represents an average value of the delivery pressures of the hydraulic pumps 1, 2, and the vertical axis represents the tilting (displacement) of the hydraulic pump 1 or 2. As the control pressure from the solenoid control valve 32 rises (i.e., as the setting value determined depending on the difference between the force of the spring 22*d* and the hydraulic force introduced to the pressure bearing chamber 22*c* reduces), an absorption torque characteristic of the second servo valve 22 changes as indicated by A1, A2 and A3 in this order, and a maximum absorption torque of the hydraulic pump 1 or 2 decreases as indicated by T1, T2 and T3 in this order. Also, as the control pressure from the solenoid control valve 32 lowers (i.e., as the setting value determined depending on the difference between the force of the spring 22*d* and the hydraulic force introduced to the pressure bearing chamber 22*c* increases), the absorption torque characteristic of the second servo valve 22 changes as indicated by A1, A4 and A5 in this order, and the maximum absorption torque of the hydraulic pump 1 or 2 increases as indicated by T1, T4 and T5 in this order. In other words, by raising the control pressure to reduce the setting value, the maximum absorption torque of the hydraulic pump 1 or 2 decreases, and by lowering the control pressure to increase the setting value, the maximum absorption torque of the hydraulic pump 1 or 2 increases.

The solenoid control valves 30, 31 and 32 are proportional pressure reducing valves operated by drive currents SI1, SI2 and SI3, respectively. The solenoid control valves 30, 31 and 32 operate so as to maximize output control pressures when the drive currents SI1, SI2 and SI3 are minimum, and to lower the output control pressures as the drive currents SI1, SI2 and SI3 increase. The drive currents SI1, SI2 and SI3 are outputted from a machine body controller 70 shown in FIG. 5.

The prime mover 10 is a diesel engine and includes an electronic fuel injector 14 operated in response to a signal indicative of a target fuel injection amount FN1. The command signal is outputted from a fuel injector controller 80 shown in FIG. 5. The electronic fuel injector 14 controls the revolution speed and output of the prime mover (hereinafter referred to as an "engine") 10.

There is provided a target engine revolution speed input unit 71 through which the operator manually inputs a target revolution speed NR1 for the engine 10. An input signal indicative of the target revolution speed NR1 is taken into the machine body controller 70 and the engine fuel injector controller 80. The target engine revolution speed input unit 71 is an electrical input means, such as a potentiometer, and the operator instructs a target revolution speed as a reference (i.e., a target reference revolution speed).

Further, there are provided a revolution speed sensor 72 for detecting an actual revolution speed NE1 of the engine 10, pressure sensors 73, 74 (see FIG. 3) for detecting the respective control pilot pressures PP1, PP2 for the hydraulic pumps 1, 2, pressure sensors 75, 76 for detecting respective tiltings SR1, SR2 of the hydraulic pumps 1, 2, and pressure sensors 77, 78 (see FIG. 3) for detecting respective delivery pressures DP1, DP2 of the hydraulic pumps 1, 2.

Figure 5:
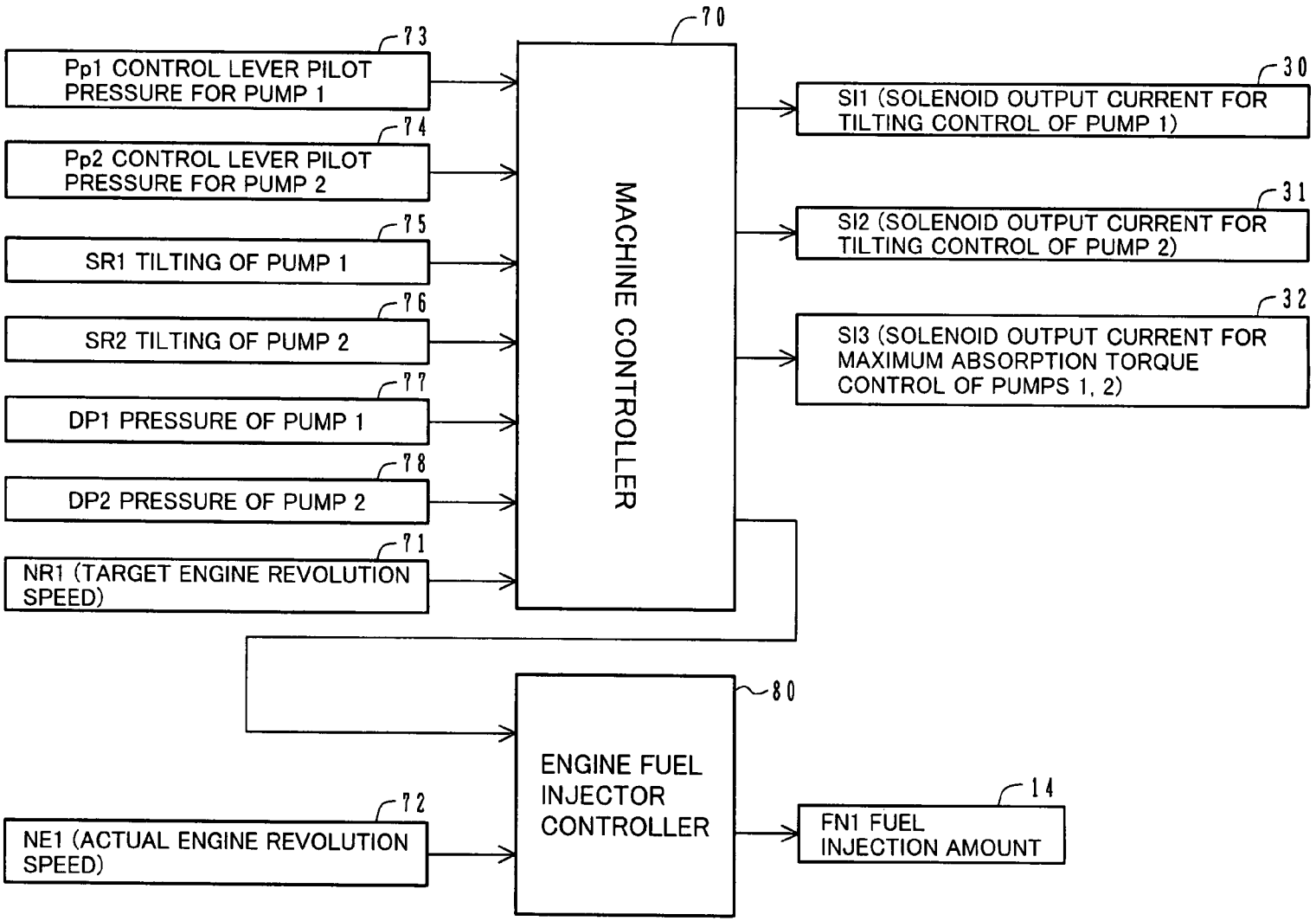
FIG. 5 is a block diagram showing controllers (i.e., a machine body controller and an engine fuel injector controller) constituting an arithmetic operation control unit of the engine/pump control system, as well as input and output relationships of the controllers.

FIG. 5 shows input and output relationships of all signals to and from the machine body controller 70 and the fuel injector controller 80.

The machine body controller 70 receives a signal indicative of the target revolution speed NR1 from the target engine revolution speed input unit 71, signals indicative of the pump control pilot pressures PP1, PP2 from the pressure sensors 73, 74, signals indicative of the tiltings SR1, SR2 from the pressure sensors 75, 76, and signals indicative of the pump delivery pressures DP1, DP2 from the pressure sensors 77, 78. After executing predetermined arithmetic processing based on those input signals, the machine body controller 70 outputs the drive currents SI1, SI2 and SI3 to the solenoid control valves 30-32, respectively, and it also outputs the signal indicative of the target revolution speed NR1 to the fuel injector controller 80. The engine fuel injector controller 80 receives the signal indicative of the target revolution speed NR1 from the machine body controller 70 and a signal indicative of the actual revolution speed NE1 from the revolution speed sensor 72. After executing predetermined arithmetic processing based on those input signals, the fuel injector controller 80 outputs a signal indicative of the target fuel injection amount FN1 to the electronic fuel injector 14.

Figure 6:
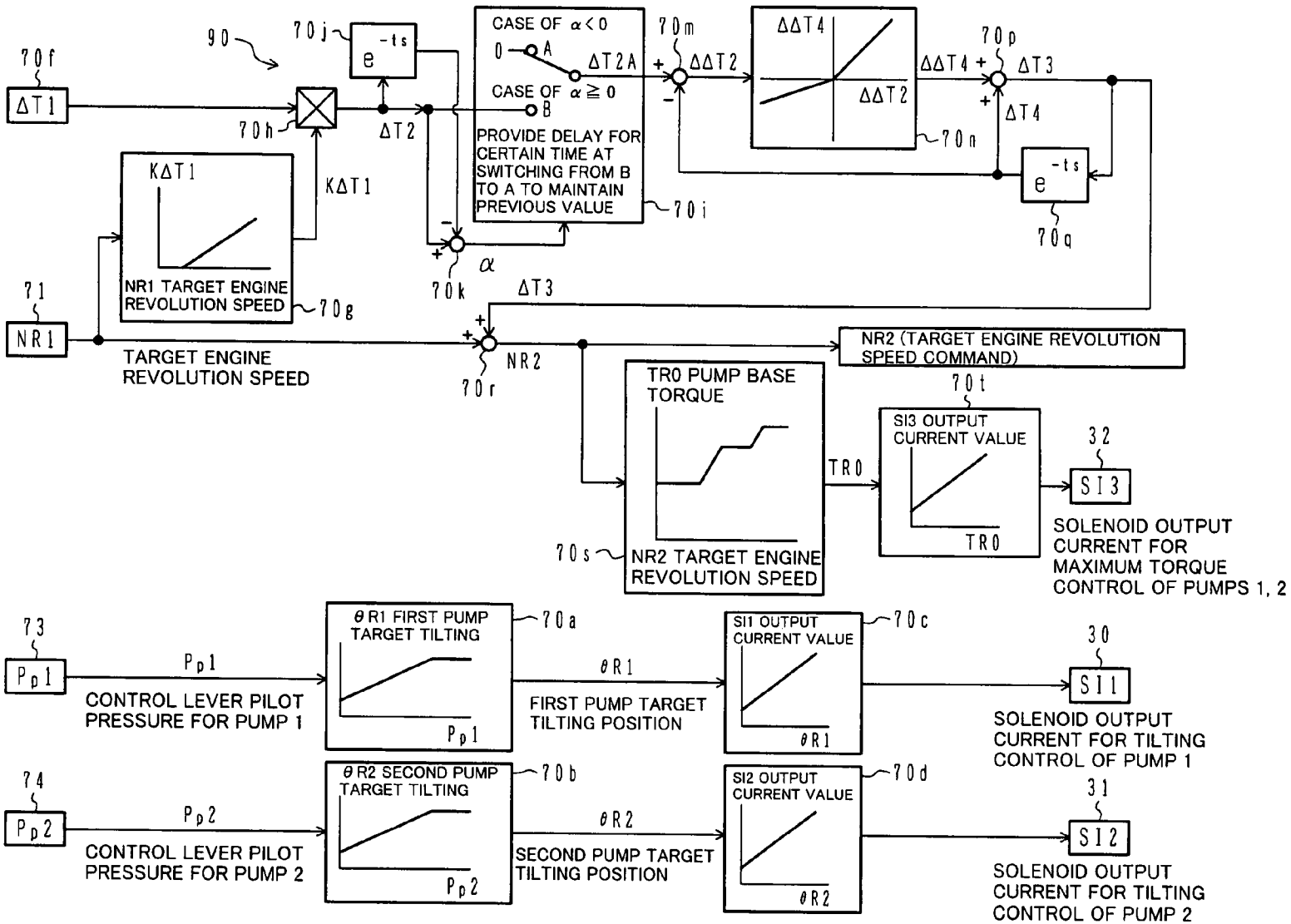
FIG. 6 is a functional block diagram showing the processing functions of the machine body controller.
Figure 7:
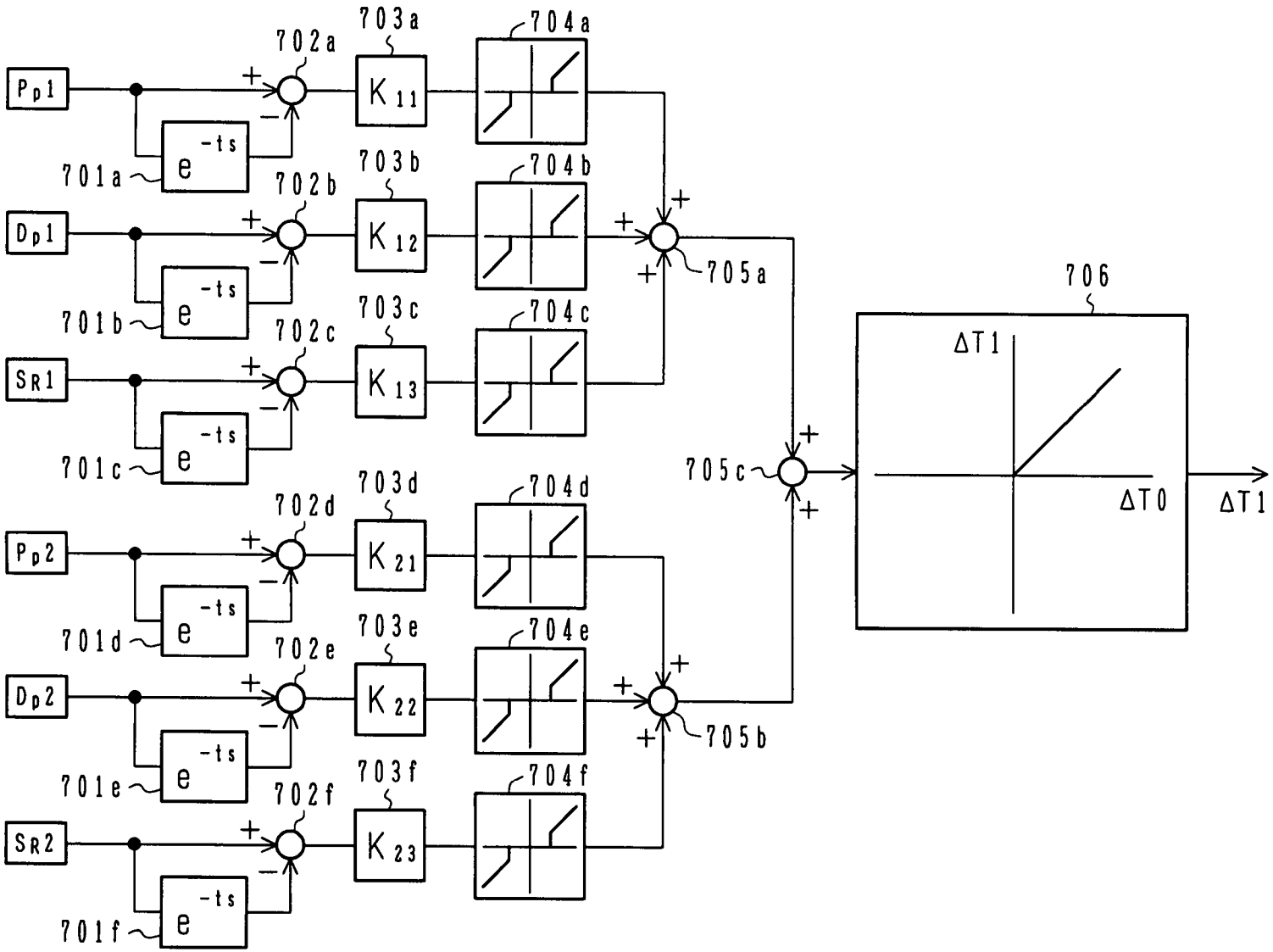
FIG. 7 is a functional block diagram showing the processing functions of an engine load increase amount computing unit in the machine body controller.

FIGS. 6 and 7 show the processing functions of the machine body controller 70 in relation to control of the hydraulic pumps 1, 2 and computation of the target revolution speed NR1.

Referring to FIG. 6, the machine body controller 70 has various functions executed by pump target tilting computing units 70*a*, 70*b*, solenoid output current computing units 70*c*, 70*d*, an engine load increase amount computing unit 70*f*, an engine revolution speed increase gain computing unit 70*g*, a multiplier 70*h*, an engine revolution speed increment value selector 70*i*, a primary delay element 70*j*, a subtracter 70*k*, a subtracter 70*m*, a gain multiplier 70*n*, an integral adder 70*p*, a primary delay element 70*q*, a modification value adder 70*r*, a base torque computing unit 70*s*, and a solenoid output current computing unit 70*t*.

The pump target tilting computing unit 70*a* receives the signal indicative of the control pilot pressure PP1 on the side of the hydraulic pump 1 and computes a target tilting θR1 of the hydraulic pump 1 corresponding to the control pilot pressure PP1 at that time by referring to a table, which is stored in a memory, based on the input signal. The computed target tilting θR1 serves as a basis for metering of a reference flow rate in the positive tilting control with respect to the input amounts by which the pilot operation devices 38, 40, 41 and 42 are manipulated. The table stored in the memory sets therein the relationship between PP1 and θR1 such that, as the control pilot pressure PP1 rises, the target tilting θR1 is also increased.

The solenoid output current computing unit 70*c* determines, on the computed θR1, the drive current SI1 for the tilting control of the hydraulic pump 1 at which that θR1 is obtained, and then outputs the determined drive current SI1 to the solenoid control valve 30.

Also, in the pump target tilting computing unit 70*b* and the solenoid output current computing unit 70*d*, the drive current SI2 for the tilting control of the hydraulic pump 2 is computed from the signal indicative of the pump control pilot pressure PP2, and then outputted to the solenoid control valve 31 in a similar manner.

The engine load increase amount computing unit 70*f*, the engine revolution speed increase gain computing unit 70*g*, the multiplier 70*h*, the engine revolution speed increment value selector 70*i*, the primary delay element 70*j*, the subtracter 70*k*, the subtracter 70*m*, the gain multiplier 70*n*, the integral adder 70*p*, and the primary delay element 70*q* constitute a means 90 (hereinafter referred to as a "revolution speed modification value computing unit") for computing the increase amount of the engine revolution speed, as a revolution speed modification value ΔT3, based on respective change rates of the control pilot pressures PP1, PP2, the pump tiltings SR1, SR2, and the pump delivery pressures DP1, DP2, which are status variables related to the loads of the hydraulic pumps 1, 2. The modification value adder 70*r* adds the revolution speed modification value ΔT3 to the target engine revolution speed NR1 applied from the input unit 71, and then inputs the resulting sum, as a target engine revolution speed NR2 for use in the control, to the base torque computing unit 70*s*. These points will be described in more detail below.

The engine load increase amount computing unit 70*f* receives the status variables regarding the load of each hydraulic pump, and computes an engine load increase amount ΔT1.

FIG. 7 shows details of the processing functions of the engine load increase amount computing unit 70*f*. The engine load increase amount computing unit 70*f* has the functions executed by primary delay elements 701*a*, 701*b*, 701*c*, 701*d*, 701*e* and 701*f*, subtracters 702*a*, 702*b*, 702*c*, 702*d*, 702*e* and 702*f*, gain multipliers 703*a*, 703*b*, 703*c*, 703*d*, 703*e* and 703*f*, filtering units 704*a*, 704*b*, 704*c*, 704*d*, 704*e* and 704*f*, adders 705*a*, 705*b* and 705*c*, as well as a filtering unit 706.

The engine load increase amount computing unit 70*f* receives the signals indicative of the control pilot pressures PP1, PP2, the signals indicative of the pump tiltings SR1, SR2, and the signals indicative of the pump delivery pressures DP1, DP2, and computes respective input speeds of those signals by taking the differences between the previous and current input values in the subtracters 702*a*-702*f*. The computed input speeds represent change rates of the corresponding status variables. Then, the input speeds are multiplied by respective gains Knn in the gain multipliers 703*a*-703*f*, and the resulting values are obtained as load increase amounts. Then, the signals are introduced to the filtering units 704*a*-704*f* to pass through respective filters such that the load increase amounts are made zero when their changes are small. The filtered load increase amounts are totalized by the adders 705*a*-705*c*. Finally, the filtering unit 706 allows only a positive value of the totalized load increase amount, which represents the load increasing direction, to pass through it, thereby obtaining the positive value as the load increase amount ΔT1.

Returning to FIG. 6, the engine revolution speed increase gain computing unit 70*g* computes a gain KΔT1 as a function of the target revolution speed NR1 inputted to it. The gain KΔT1 is multiplied by the load increase amount ΔT1 in the multiplier 70*h* to obtain an engine revolution speed increase amount ΔT2. The engine revolution speed increase gain computing unit 70*g* stores the relationship between NR1 and KΔT1 set such that the gain KΔT1 reduces as the target revolution speed NR1 decreases. Accordingly, when the target revolution speed NR1 is low, the gain KΔT1 is set to a relatively small value and the engine revolution speed increase amount ΔT2 is computed as a relatively small value in the multiplier 70*h*.

The subtracter 70*k* computes the difference between the current value of the engine revolution speed increase amount ΔT2 and the previous value thereof which is supplied from the primary delay element 70*j*, to thereby produce a determination value α. The determination value α takes a positive, negative or zero (0) value depending on the presence or absence of change of the engine revolution speed increase amount ΔT2 and the direction of the change. More specifically, the determination value α takes a positive value when the engine revolution speed increase amount ΔT2 is changed in the increasing direction, and a negative value when it is changed in the decreasing direction. Also, the determination value α is 0 when the engine revolution speed increase amount ΔT2 is not changed (i.e., when it is constant).

The engine revolution speed increment value selector 70*i* determines whether the determination value α is positive, negative or 0, and it switches over an engine revolution speed increment value ΔT2A, which is applied to the subtracter 70*m*, depending on the determination result. If $\alpha \geqq 0$ (namely if the engine revolution speed increase amount ΔT2 is changed in the increasing direction, or if ΔT2 is not changed), the selector 70*i* is held in a state B to select the engine revolution speed increase amount ΔT2 so that the engine revolution speed increase amount ΔT2 is outputted as the increment value ΔT2A applied to the subtracter 70*m*. If $\alpha < 0$ (namely if the engine revolution speed increase amount ΔT2 is changed in the decreasing direction), the selector 70*i* takes a state A to select 0 as the increment value ΔT2A applied to the subtracter 70*m*. At the time of switching from the state B to A, the operation is delayed for a certain time (e.g., 3 seconds) to provide the hold function of maintaining the previous value.

The subtracter 70*m* subtracts a revolution speed modification value ΔT4 in the previous cycle from the increment value ΔT2A selected by the engine revolution speed increment value selector 70*i*, thereby obtaining a deviation ΔΔT2.

The gain multiplier 70*n* serves to give the deviation ΔΔT2 a primary delay. A primary delay gain is set to 1 when the deviation ΔΔT2 is in the increasing direction (i.e., $\Delta\Delta T2 \geqq 0$), and to a value smaller than 1 when the deviation ΔΔT2 is in the decreasing direction (i.e., $\Delta\Delta T2 < 0$). The gain is multiplied by ΔΔT2 to obtain a deviation ΔΔT4.

The integral adder 70*p* adds ΔΔT4 to the revolution speed modification value ΔT4 in the previous cycle which is supplied from the primary delay element 70*q*, thereby obtaining the revolution speed modification value ΔT3 in the current cycle.

The revolution speed modification value ΔT3 thus computed is applied to the modification value adder 70*r*, and the modification value adder 70*r* adds the revolution speed modification value ΔT3 to the target revolution speed NR1, thereby obtaining the target revolution speed command NR2 for use in the control.

The base torque computing unit 70*s* receives the target revolution speed command NR2 from the modification value adder 70*r*, and computes a pump base torque TR0 corresponding to the target revolution speed command NR2 at that time by referring to a table, which is stored in a memory, based on the input signal. The solenoid output current computing unit 70*t* determines the drive current SI3 for the solenoid control valve 32 at which the maximum absorption torque of the hydraulic pump 1, 2 controlled by the second servo valve 22 becomes TR0, and then outputs the determined drive current SI3 to the solenoid control valve 32.

The solenoid control valve 32 having received the drive current SI3 in such a way outputs a control pressure corresponding to the received drive current SI3 and controls the setting value in the second servo valve 22, thereby controlling the maximum absorption torque of the hydraulic pump 1, 2 to be TR0.

Figure 8:
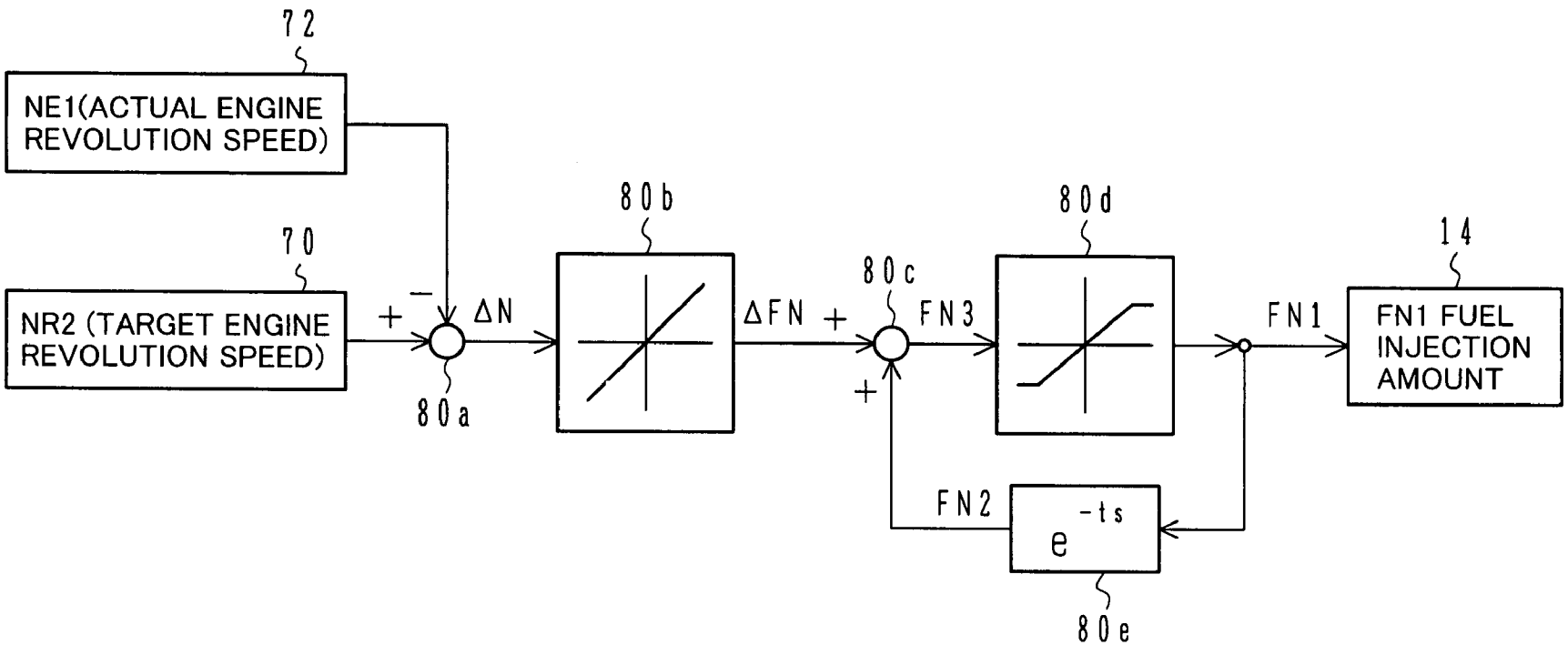
FIG. 8 is a functional block diagram showing the processing functions of the fuel injector controller.

FIG. 8 shows the processing functions of the fuel injector controller 80.

The fuel injector controller 80 has the control functions executed by a revolution speed deviation computing unit 80*a*, a fuel injection amount converting unit 80*b*, an integral adder 80*c*, a limiter computing unit 80*d*, and a primary delay element 80*e*.

The revolution speed deviation computing unit 80*a* compares the target revolution speed NR2 with the actual revolution speed NE1 to obtain a revolution speed deviation ΔN (=NR2−NE1), and the fuel injection amount converting unit 80*b* multiplies the revolution speed deviation ΔN by a gain KF to compute an increment ΔFN of the target fuel injection amount. The integral adder 80*c* adds the increment ΔFN of the target fuel injection amount to the previous value FN2 of the target fuel injection amount FN1 which is supplied from the primary delay element 80*e*, thereby computing a new target fuel injection amount FN3. The limiter computing unit 80*d* multiplies the target fuel injection amount FN3 by upper and lower limiters to obtain the target fuel injection amount FN1. This target fuel injection amount FN1 is converted to a corresponding control current that is outputted to the electronic fuel injector 14 for control of the fuel injection amount. With such a process, the target fuel injection amount FN1 is computed through the integral operation such that when the actual revolution speed NE1 is lower than the target revolution speed NR2 (i.e., when the revolution speed deviation ΔN is positive), the target fuel injection amount FN1 is increased, and when the actual revolution speed NE1 exceeds the target revolution speed NR2 (i.e., when the revolution speed deviation ΔN becomes negative), the target fuel injection amount FN1 is decreased, i.e., such that the deviation ΔN of the actual revolution speed NE1 from the target revolution speed NR2 becomes 0. The fuel injection amount is thereby controlled so as to make the actual revolution speed NE1 matched with the target revolution speed NR2.

Features in operation of this embodiment having the above-described construction will be described below with reference to FIGS. 9 and 10.

Figure 9:
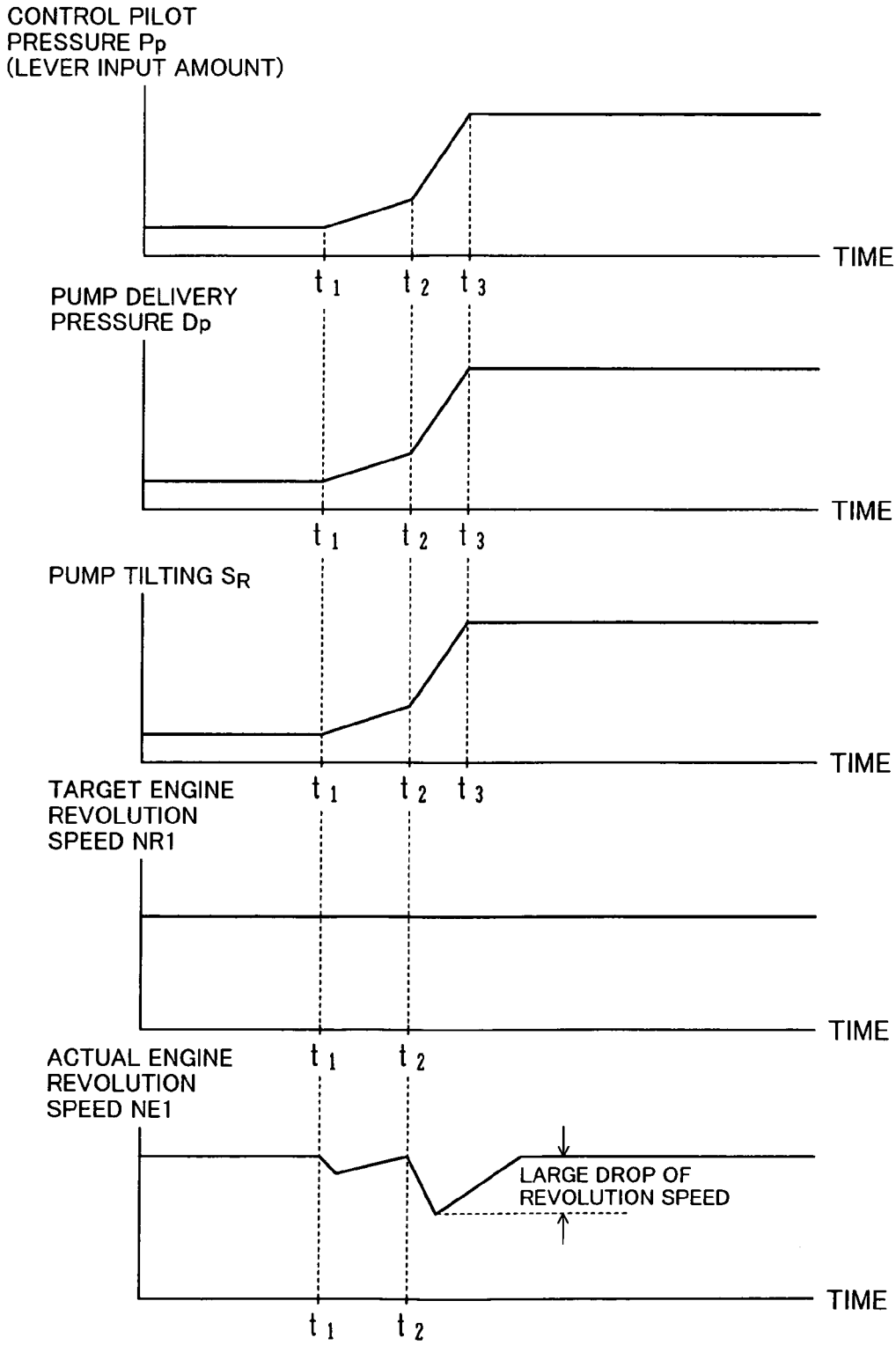
FIG.9 PRIOR ART
FIG. 9 is a time chart showing changes of the engine revolution speed with the application of a load in the prior art.
Figure 10:
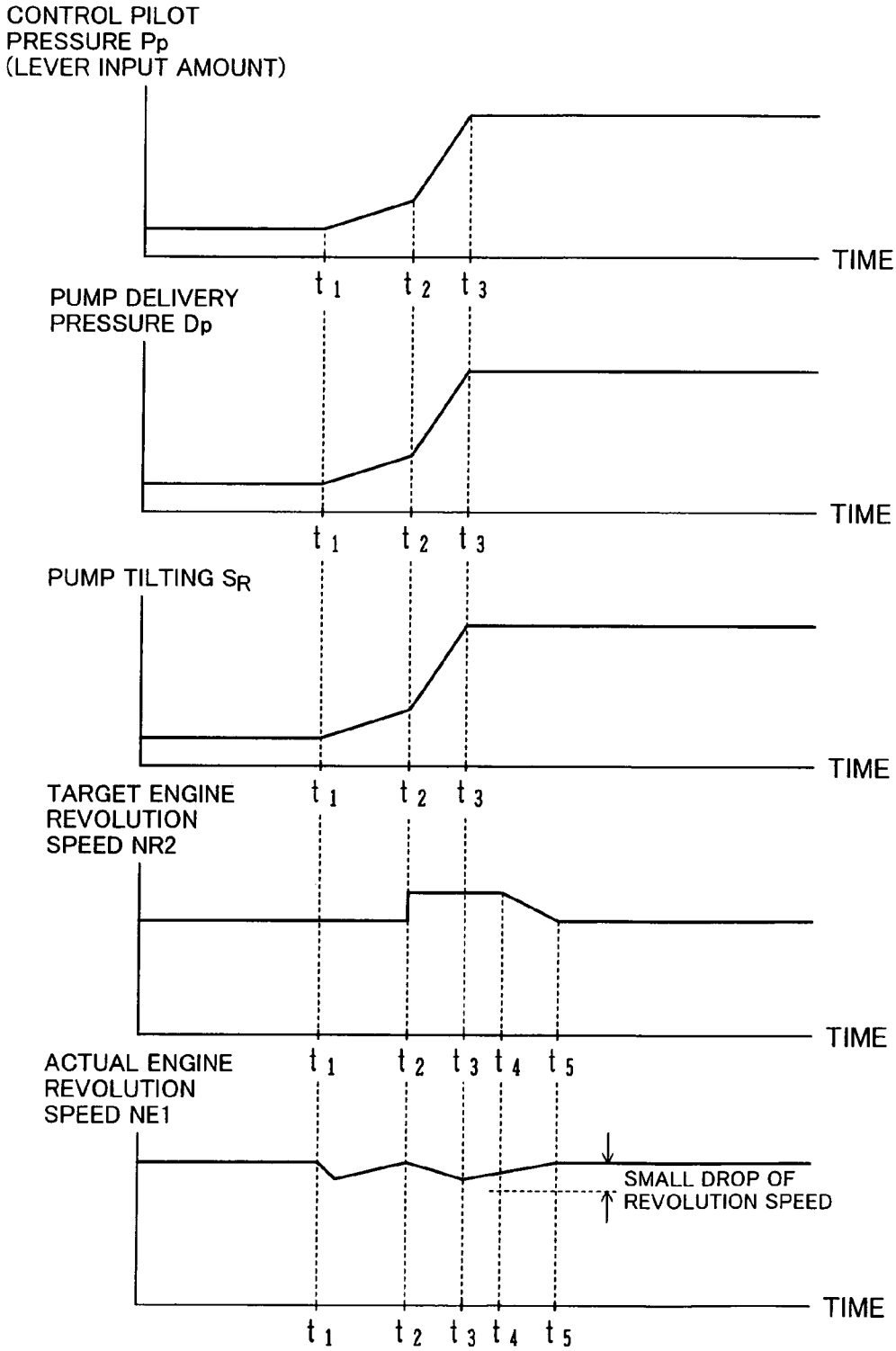
FIG. 10 is a time chart showing changes of the engine revolution speed with the application of a load in the first embodiment of the present invention.

FIG. 9 is a time chart showing changes of the engine revolution speed responsive to changes of an operation input in the prior art, and FIG. 10 is a time chart showing changes of the engine revolution speed responsive to changes of an operation input in this embodiment. In each of FIGS. 9 and 10, individual charts indicate the pump control pilot pressure PP1 or PP2 (represented by PP hereinafter), the pump delivery pressure DP1 or DP2 (represented by DP hereinafter), the pump tilting SR1 or SR2 (represented by SR hereinafter), the target revolution speed NR1 (FIG. 9) or NR2 (FIG. 10), and the actual engine revolution speed NE1 in this order from above. The pump control pilot pressure PP is a value corresponding to a lever input amount applied from any of the operation pilot devices 38-44 shown in FIG. 3. Also, it is assumed that the target revolution speed NR1 applied from the input unit 71 is constant, and that the control lever is slightly manipulated at time t1, quickly manipulated at time t2, and then stopped at time t3. It is further assumed that, during each of periods from the time t1 to t2 and from the time t2 to t3, respective change rates of the pump control pilot pressure PP, the pump delivery pressure DP, and the pump tilting SR are constant.

In the prior art, as shown in FIG. 9, when the control lever is slightly manipulated at the time t1, the engine revolution speed drops in small amount. However, when the control lever is quickly manipulated at the time t2, the pump delivery pressure DP and the pump tilting SR are quickly increased correspondingly, whereupon the actual engine revolution speed NE1 drops abruptly. At this time, a drop amount of the actual revolution speed NE1 is large.

In contrast, according to this embodiment, when the control lever is quickly manipulated at the time t2, the target revolution speed command NR2 is modified by the revolution speed modification value computing unit 90 such that the target revolution speed increases from the target revolution speed NR1 applied from the input unit 71, and then it moderately returns to the target revolution speed NR1. Therefore, an abrupt drop of the actual engine revolution speed NE1 is avoided and the speed drop amount is reduced. Details of such a process are as follows.

From time t1 to t2:

During this period, since the control lever is slightly manipulated, the respective change rates of the pump control pilot pressure PP, the pump delivery pressure DP, and the pump tilting SR are so small that the signals inputted to the filtering units 704*a*-704*f* of the engine load increase amount computing unit 70*f*, shown in FIG. 7, are processed to become zero through the respective filters. In this case, therefore, the load increase amount ΔT1 computed in the engine load increase amount computing unit 70*f* is 0 and the revolution speed modification value ΔT3 is also 0, whereby the target revolution speed NR2 (=NR1) is constant. As a result, the actual engine revolution speed NE1 changes in the same manner as in the prior art.

From time t2 to t3:

During this period, since the control lever is quickly manipulated, the load increase amount ΔT1 is computed as a value other than 0 in the engine load increase amount computing unit 70*f*, and the multiplier 70*h* multiplies the load increase amount ΔT1 by the gain KΔT1 depending on the target revolution speed NR1 at that time to compute the engine revolution speed increase amount ΔT2.

In the first cycle of an arithmetic operation process at the time t2, the previous value of the engine revolution speed increase amount ΔT2 is zero. Therefore, the subtracter 70*k* computes a positive determination value α, and the engine revolution speed increment value selector 70*i* takes the state B so that the engine revolution speed increase amount ΔT2 computed by the multiplier 70*h* is introduced as the increment value ΔT2A to the subtracter 70*m*. Further, because the previous value of the revolution speed modification value ΔT3 is zero, the subtracter 70*m* computes the increment value ΔT2 (=the engine revolution speed increase amount ΔT2) as the deviation ΔΔT2, and the gain multiplier 70*n* outputs the deviation ΔΔT4 (=ΔΔT2) as a value resulting from multiplying the deviation ΔΔT2 by the gain of 1. The deviation ΔΔT4 is applied to the integral adder 70*p*. At this time, the deviation ΔΔT4 is given as the revolution speed modification value ΔT3 because the previous value of the revolution speed modification value ΔT3 is zero. Thus, as shown in FIG. 10, the target revolution speed NR2 is increased by a value corresponding to ΔT3 at the time t2.

During the period from the time t2 to t3, since the respective change rates of the pump control pilot pressure PP, the pump delivery pressure DP, and the pump tilting SR are constant, the arithmetic operation processes are executed as follows. The input speeds computed in the subtracters 702*a*-702*f* shown in FIG. 7 are provided as the same values as those in the previous cycle. Responsively, the load increase amount ΔT1 is computed as the same value, and further the engine revolution speed increase amount ΔT2 is computed as the same value. Therefore, the subtracter 70*k* computes the determination value α=0, and the engine revolution speed increment value selector 70*i* holds the state B so that the engine revolution speed increase amount ΔT2 computed by the multiplier 70*h* is introduced as the increment value ΔT2A to the subtracter 70*m*.

Thus, in the second and subsequent cycles of the arithmetic operation process, the previous value of the revolution speed modification value ΔT3 is equal to the increment value ΔT2A computed in the current cycle. Accordingly, the subtracter 70*m* computes the deviation ΔΔT2=0, and the gain multiplier 70*n* also computes the deviation ΔΔT4=0, whereby the previous value of the revolution speed modification value ΔT3 is maintained. As a result, during the period from the time t2 to t3, the target revolution speed NR2 is maintained at the increased value as shown in FIG. 10.

From time t3 to t4:

When the lever manipulation is stopped at the time t3, the pump control pilot pressure PP, the pump delivery pressure DP, and the pump tilting SR are held constant. Therefore, the input speeds computed in the subtracters 702*a*-702*f* shown in FIG. 7 are provided as negative values. Responsively, the load increase amount ΔT1 is computed as a negative value, and further the engine revolution speed increase amount ΔT2 is computed as a negative value. Therefore, the subtracter 70*k* computes a negative determination value α, and the engine revolution speed increment value selector 70*i* holds the previous value for a certain time (e.g., 3 seconds). Thus, during the holding period of the selector 70*i*, the previous value of the revolution speed modification value ΔT3 is maintained as in the above-described period from t2 to t3. As a result, for the certain time after t3, the target revolution speed NR2 is maintained at the increased value as shown in FIG. 10.

From time t4 to t5:

When reaching the time t4 after the lapse of the certain time, the engine revolution speed increment value selector 70*i* switches over from the state B to A, whereupon the increment value ΔT2A is set to 0. Therefore, the subtracter 70*m* computes the previous negative value of the revolution speed modification value ΔT3 as the deviation ΔΔT2, and the gain multiplier 70*n* outputs the deviation ΔΔT4 (<0) as a value resulting from multiplying the deviation ΔΔT2 by the gain smaller than 1. The deviation ΔΔT4 is applied to the integral adder 70*p*. Accordingly, the revolution speed modification value ΔT3 computed by the integral adder 70*p* is smaller than the previous value, and the target revolution speed NR2 is also smaller than the previous value. Thus, as shown in FIG. 10, the target revolution speed NR2 decreases gradually after the time t4.

After time t5:

When the revolution speed modification value ΔT3 reaches 0 (ΔT3=0) at the time t5, the deviation ΔΔT2 computed by the subtracter 70*m* also becomes 0, and the revolution speed modification ΔT3 is maintained at 0. As a result, the target revolution speed NR2 is returned to NR1 after the time t5.

With this embodiment, as described above, the engine control system includes status variable detecting means, i.e., the pressure sensors 73, 74, the position sensors 75, 76 and the pressure sensors 77, 78, for detecting status variables related to the loads of the hydraulic pumps 1, 2, and target revolution speed modifying means made up of the target revolution speed modification value computing unit 90 and the modification value adder 70*r*. The target revolution speed NR2 for use in the control is computed based on changes of the status variables such that the target revolution speed NR2 for use in the control increases from the target revolution speed NR1 applied from the input unit 71, and then moderately returns to the target revolution speed NR1. In accordance with the thus-computed target revolution speed NR2 for use in the control, the target fuel injection amount FN1 is computed and the fuel injection amount is controlled. Therefore, when the engine load is abruptly increased, it is possible to not only suppress a drop of the engine revolution speed, but also to keep the engine revolution speed from going up beyond a required level and to prevent lowering of durability caused by an excessive increase of the engine revolution speed.

Also, the above control process is performed on the basis of engine revolution speed without reducing the absorption torques of the hydraulic pumps 1, 2. Therefore, the hydraulic pumps 1, 2 can maintain the same maximum delivery rate as that obtained in the case not performing the above-described control, and the work efficiency is not sacrificed.

Further, the control process is performed by computing the target revolution speed NR2 for use in the control based on changes of the status variables such that the target revolution speed NR2 increases from the target revolution speed NR1 applied from the input unit 71, is maintained at the increased engine revolution speed for a certain time after detection of the changes of the status variables has ceased, and then moderately returns to the target revolution speed NR1. Therefore, a drop of the engine revolution speed attributable to an abrupt increase of the engine load can be suppressed with certainty.

Moreover, the engine revolution speed increase gain computing unit 70*g* is provided to compute the revolution speed modification value ΔT3, i.e., the increase amount of the target revolution speed, as a variable value depending on the target revolution speed NR1 which is set in accordance with a command applied from the input unit 71. Therefore, as the target revolution speed NR1 set in accordance with the command applied from the input unit 71 changes, the increase amount of the target revolution speed (i.e., the revolution speed modification value ΔT3) is also changed correspondingly. Hence, an optimum increase amount of the target revolution speed (i.e., the revolution speed modification value ΔT3) can be computed regardless of the target revolution speed NR1, and the control for suppressing a drop of the engine revolution speed can be performed in an appropriate manner without causing an excessive increase of the engine revolution speed.

In addition, since the control pilot pressures PP1, PP2 (lever input amounts), the pump tiltings SR1, SR2 and the pump delivery pressures DP1, DP2 are detected and used in the control as the status variables related to the loads of the hydraulic pumps 1, 2, the load states of the hydraulic pumps 1, 2 can be confirmed with high accuracy. From this point of view, too, the control for suppressing a drop of the engine revolution speed can be performed in an appropriate manner.

INDUSTRIAL APPLICABILITY

According to the present invention, it is possible to suppress a drop of the engine revolution speed attributable to an abrupt increase of the engine load without sacrificing the work efficiency, and to prevent lowering of durability caused by an excessive increase of the engine revolution speed.

The invention claimed is:

1. An engine control system for a construction machine comprising an engine (10), at least one variable displacement hydraulic pump (1, 2) driven by said engine, a plurality of hydraulic actuators (50-56) driven by a hydraulic fluid delivered from said hydraulic pump, a plurality of flow control valves (5*a*-5*i*) for controlling respective flow rates of the hydraulic fluid supplied from said hydraulic pump to said plurality of hydraulic actuators, operating means (38-44) for operating said plurality of flow control valves, a fuel injector (14) for controlling a revolution speed of said engine, input means (71) for commanding a target revolution speed (NR1) of said engine, and fuel injection amount control means (80) for computing a target fuel injection amount (FN1) based on the target revolution speed and controlling said fuel injector, wherein said engine control system comprises status variable detecting means (73-78) for detecting a status variable related to a load of said hydraulic pump (1, 2), and target revolution speed modifying means (70*f*-70*r*) for computing a target revolution speed (NR2) for use in control based on a change of the status variable such that the target revolution speed for use in control increases from the target revolution speed (NR1) set in accordance with a command from said input means (71), and then moderately returns to the target revolution speed set in accordance with the command from said input means, said fuel injection amount control means (80) computing the target fuel injection amount (FN1) based on the target revolution speed for use in control.

2. An engine control system for a construction machine according to claim 1, wherein said target revolution speed modifying means (70*f*-70*r*; 70*i*, 70*j*, 70*k*) maintains the increased engine revolution speed (NR2) for a certain time after the change of the status variable has ceased.

3. An engine control system for a construction machine according to claim 1, wherein said target revolution speed modifying means (70*f*-70*r*; 70*g*, 70*h*) computes an increase amount of the target revolution speed (NR2) as a variable value depending on the target revolution speed (NR1) set in accordance with the command from said input means (71).

4. An engine control system for a construction machine according to claim 1, wherein said target revolution speed modifying means (70*f*-70*r*) includes means (70*f*-70*q*) for computing, based on the change of the status variable, an engine revolution speed modification value (ΔT3) which increases from 0 by a predetermined amount and then moderately returns to 0, and means (70*r*) for adding the engine revolution speed modification value to the target revolution speed (NR1) set in accordance with the command from said input means (71).

5. An engine control system for a construction machine according to claim 1, wherein said status variable detecting means (73-78) detects, as the status variable related to the load of said hydraulic pump (1, 2), at least one of operation signals from said operating means (38-44), a delivery capacity of said hydraulic pump, and a delivery pressure of said hydraulic pump.

* * * * *